United States Patent [19]

Brown

[11] Patent Number: 4,815,707

[45] Date of Patent: Mar. 28, 1989

[54] NAIL PULLER

[76] Inventor: Henry R. Brown, 341 La Jolla Dr., Newport Beach, Calif. 92663

[21] Appl. No.: 126,511

[22] Filed: Nov. 30, 1987

[51] Int. Cl.[4] ..... B66F 15/00

[52] U.S. Cl. ..... 254/22; 254/27

[58] Field of Search ..... 254/22, 23, 18, 27, 254/129; 81/341

[56] References Cited

U.S. PATENT DOCUMENTS

| | | | |
|---|---|---|---|
| 743,318 | 11/1903 | Norris | 254/22 |
| 1,687,974 | 10/1928 | Dickie | 254/22 |
| 1,729,264 | 9/1929 | Fitch | 81/341 |
| 2,375,512 | 5/1945 | Baade | 81/341 |
| 4,097,021 | 6/1978 | Loboda | 254/22 |
| 4,531,716 | 7/1985 | Rish | 254/21 |

*Primary Examiner*—Robert C. Watson

*Attorney, Agent, or Firm*—Roy A. Ekstrand

[57] ABSTRACT

A nail puller defines an elongated body having a static gripping jaw formed therein and a handle socket for receiving a handle. An elongated handle is threadably received within the handle socket. A moveable jaw is pivotally attached to the puller body and defines a jaw blade and an extending lever arm. A limit stop is interposed between the lever arm and the puller body to provide a limit on the closure of the static and moveable jaws. The puller body further defines a drive receptacle for receiving a drive portion of a lever-type tool such as a drive ratchet as an alternative for the handle. In an alternate embodiment, an additional handle socket is defined by the puller body having an angular orientation different from the first handle socket permitting the use of the removeable handle in alternate configurations.

10 Claims, 1 Drawing Sheet

FIG. 1
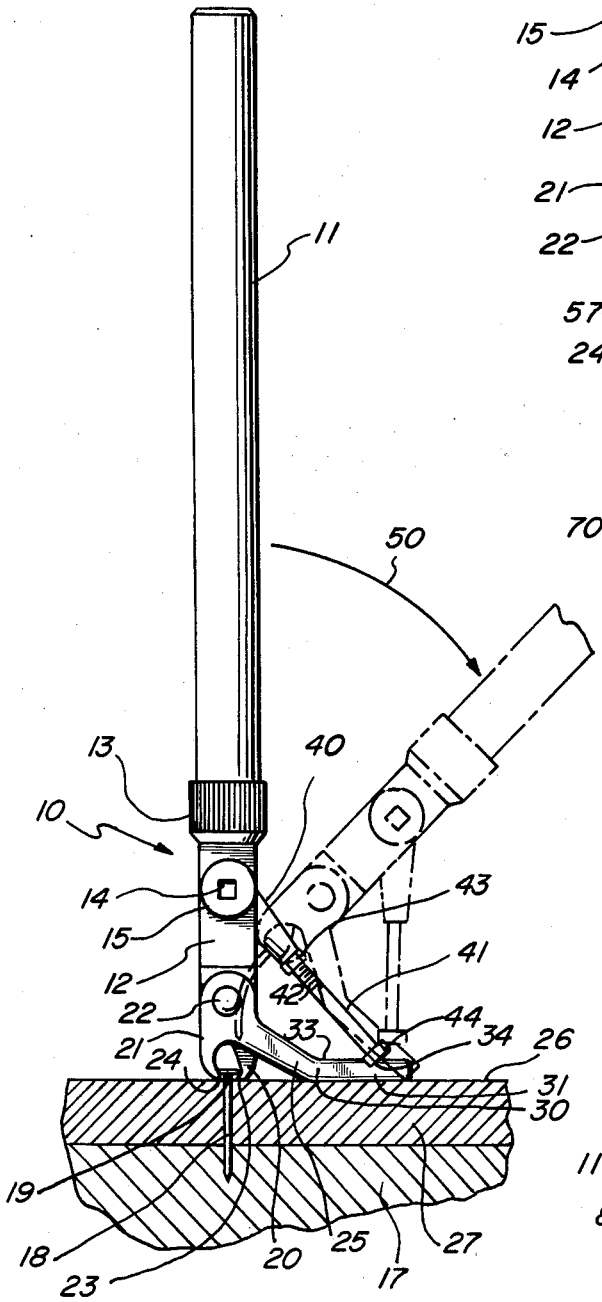
FIG. 2
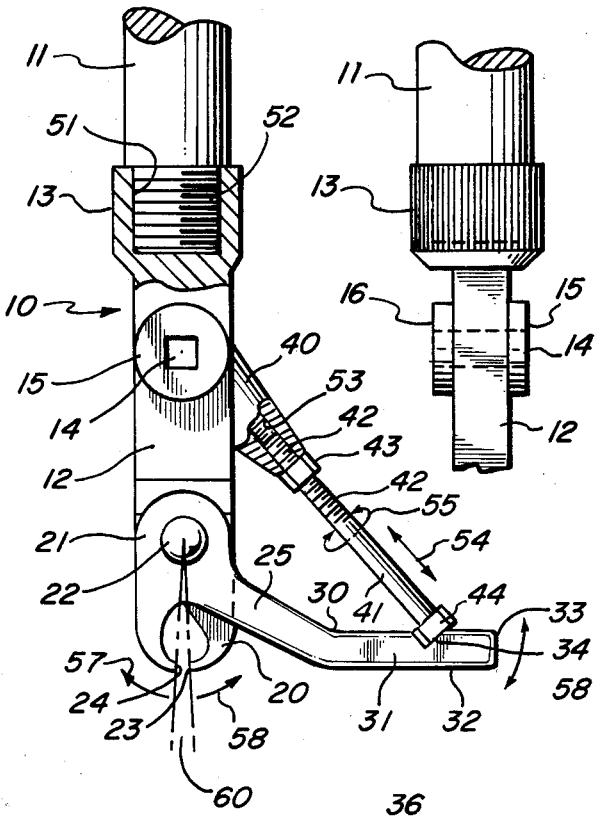
FIG. 3
FIG. 4
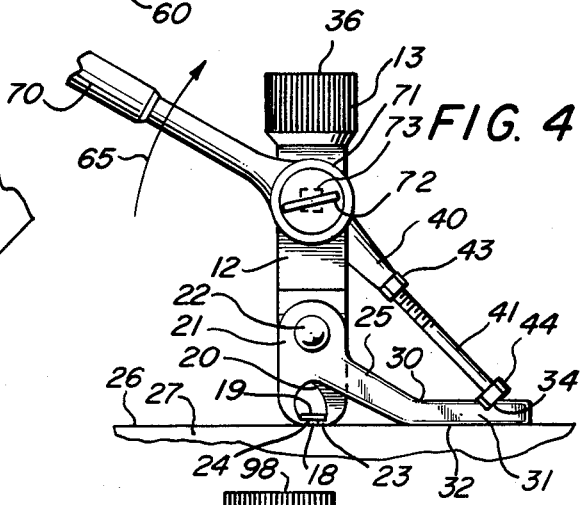
FIG. 5
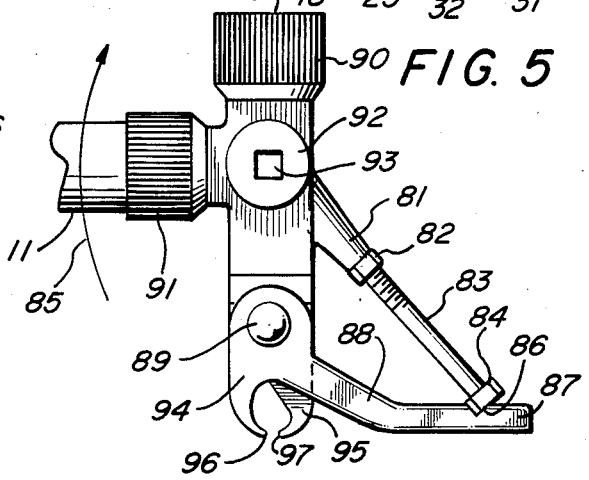

NAIL PULLER

FIELD OF THE INVENTION

This invention relates generally to pulling or extracting tools and particularly to those utilized to pull or extract an embedded nail, spike, or similar object.

BACKGROUND OF THE INVENTION

Often during construction or fabrication of objects which utilize driven fasteners such as nails, a need arises to extract a previously driven or embedded nail and remove it from the object in which it is embedded. Most commonly, objects fabricated during construction of dwellings or similar buildings are structured using multiple sets of wooden boards having a plurality of nails driven into the boards at their various joints to secure the boards with respect to each other. The common nail utilized in such dwelling or building fabrication comprises a shank portion usually cylindrical having a sharp point at one end and an extending or expanded head at the other. In the typical nailing or driving operation the nail is driven into the board point first by multiple blows to the head with a hammer or similar driving object. At completion of the driving operation, the shank and point are buried in the wooden board and the head portion is at or slightly embedded in the outer surface of the board. The shank portion of the driven nail is securely gripped by the resilient forces of the wooden object. In many instances, various surface designs are used on the nail shank to improve the nail's "holding force" within the wood.

In the event it is desirable to remove an embedded nail, most fabricators resort to a device generally referred to as "puller" or "nail puller". While the particular designs and constructions of the nail pullers are subject to considerable variety, in their most basic form they comprise a pair of jaws adapted to grip the nail shank beneath the nail head, a handle portion and a lever portion. Generally, the lever portion is coupled to one of the jaws to provide a closing force during the pulling operation. In the typical nail puller operation the jaws are set beneath the nail head upon the shank and a lateral force is applied to the handle portion causing the puller to pivot about the lever member and withdraw the nail from the board.

One such puller is set forth in U.S. Pat. No. 728,668 for a TACK EXTRACTER issued to W. H. Brown in which an elongated handle supports a static jaw to which a movable jaw is pivotally secured. The movable jaw terminates at one end in an elongated lever portion and a spring member is supported upon the static jaw so as to urge the movable jaw toward the open position when not in use to facilitate easy engagement with a nail.

U S. Pat. No. 700,757 issued to F. C. Fowler for a NAIL PULLER sets forth a puller having a static jaw secured to an elongated handle. A multiple piece movable jaw is fabricated by a pair of outer portions positioned on either side of the static jaw in a pivotal attachment. An intermediate piece forming the jaw portion of the movable jaw is riveted between the outer members in alignment with the static jaw. A lever portion is riveted to the other end of the outer portions of the movable jaw to provide a curved lever surface for operation of the puller.

U.S. Pat. No. 1,156,870 issued to P. Aiazzi for a SPIKE EXTRACTOR sets forth a puller having an elongated handle and static jaw formed of a single metal member. A movable jaw is pivotally attached to the handle and defines a lever portion extending away from the jaw portion and the pivotal attachment. The lever portion further includes roller bearing which permits the movable jaw lever portion to move with respect to the board surface during the pulling operation to facilitate a more vertical extraction of the embedded nail.

U.S. Pat. No. 943,322 issued to O. Soles for a FLIGHT EXTRACTOR sets forth a tool adapted to remove flights from a conveyor system having an elongated handle terminating at one end in a pivotally attached gripping member and a movable jaw comprising an S-shaped member terminating at one end in a similar gripping member having a pivotal attachment in alignment with the first gripping member. The S-shaped member is pivotally attached to an intermediate portion of the handle and functions in much the same manner as the above-described nail pullers to extract flights from the conveyor system.

U.S. Pat. No. 753,386 issued to Gerlach and Moore for a SPIKE PULLER sets forth a combination extracting tool having an elongated handle portion terminating at one end in a generally curved claw having a serration therein and defining a flat pointed end similar to the claw portions of a conventional carpenter's hammer. The elongated member further defines a static jaw extending oppositely from the curved claw member and a movable jaw slideably attached to the elongated handle member and linked thereto by a pivotal arm to provide a pair of jaws operable to embrace a nail head and extract the nail. Thus, the puller in U.S. Pat. No. 753,386 is operative in either a conventional claw puller or a movable jaw puller at the user's preference.

U.S. Pat. No. 4,097,02I issued to Loboda for a TIRE STUD PULLER sets forth a tire stud puller which includes a static jaw element and a pivotal element supporting a second jaw. A detachable lever member is secured to the static jaw and provides a fulcrum about which the puller rotates during use. Gripping means having a lock portion are coupled between the handle member and the movable jaw to provide the gripping force between the static and movable jaws. The gripping means functions similar to a conventional pair of locking pliers and include a release lever mechanism.

While the foregoing described puller structures provide some effectiveness in extracting an embedded nail or similar object, they are typically subject to a problem due to the relationship between the gripping force applied to the nail and the lateral or pulling force applied to the handle. In accordance with an important design feature of the prior art nail pullers, the lever member about which the puller pivots during extraction is coupled to the movable jaw such that a direct relationship exists between the pulling force applied to the handle and the gripping force applied between the jaws to the nail. While in many instances this relationship is desirable, a problem arises in that an excess in pulling force required to pull a difficult nail may produce efficient force between the jaws to sever the nail head from the nail. Once the nail head has been severed the pulling operation is rendered extremely difficult.

There arises, therefore, a need in the art for a means of utilizing the advantageous aspects of a puller in which the gripping force is related to the pulling force while avoiding the undesired result of cutting the head from the nail shank.

SUMMARY OF THE INVENTION

Accordingly, it is a general object of the present invention, to provide an improved nail puller. It is a further object of the present invention to provide an improved nail puller which is operative to utilize a gripping force related to the pulling force without severing the nail head.

In accordance with the invention, there is provided a puller for removing an embedded object having a pair of pivotally attached jaws, a handle coupled to one jaw, a lever coupled to the other jaw in an arrangement in which the jaws are movable inwardly to grip the embedded object when the handle is pivoted about the lever creating a gripping force related to the resulting force between the handle and the lever, and limit means for limiting the inward movement of the jaws.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 is a side view of a puller constructed in accordance with the present invention;

FIG. 2 is a partially sectioned view of a portion of the present invention puller;

FIG. 3 is a partial front view of the present invention nail puller;

FIG. 4 is a side view of the present invention puller used in an alternative manner; and FIG. 5 is a side view of an alternate embodiment of the present invention puller.

DESCRIPTION OF THE PREFERRED EMBODIMENTS

FIG. 1 sets forth a side view of a nail puller 10 constructed in accordance with the present invention having a puller body 12 which, in its preferred form, is formed of a rigid metal construction and which defines a handle socket 13 at one end and a static jaw 20 at the other. Static jaw 20 further defines an inwardly facing jaw blade 23. A moveable jaw 2 defines an inwardly facing jaw blade 24, an outwardly extending jaw arm 25 and a lever arm 80. Lever arm 30 is angularly positioned with respect to jaw arm 25 by a bend 30. In accordance with the invention, static jaw 20 and moveable jaw 21 are pivotally secured at a pivot 22. Puller body 12 further defines an outwardly extending boss 15 and a rectangular drive receptacle 14. As is more clearly seen in FIG. 8, puller body 12 also defines an oppositely positioned boss 16 aligned with boss 15. As is also seen in FIG. 3, drive receptacle 14 extends entirely through boss 15, puller body 12 and boss 16 to form a square passage therethrough.

A generally cylindrical elongated handle 11 is received within socket 13 by means set forth in FIG. 2 and is in general alignment with the major axis of puller body 12. The coupling between handle 11 and handle socket 13 is sufficiently secure that lateral forces applied to handle 11 are coupled directly to puller body 12 to practice the below described operation of the present invention puller.

In accordance with an important aspect of the present invention, puller body 12 further defines a downwardly extending limit boss 40 which defines an internal threaded aperture 53 (seen in FIG. 2 . A limit stop 41 defines a threaded portion 42 supporting a lock nut 43 and extending into threaded aperture 53. Limit stop 41 further defines a head 44 at the opposite end of thread 42. In further accordance with an important aspect of the present invention, lever arm 31 defines a surface 33 further defining a notch 34. Notch 34 is positioned with respect to surface 33 to receive head 44 of limit stop 41.

A wooden board 27 and a wooden board 17 are positioned in an overlapping manner typical of many construction joints. Board 27 defines a surface 26. A nail 18 having a head 19 is embedded in board 27 and extends therethrough to be partially embedded in board 17. Head 19 is positioned slightly above surface 26 and jaw blades 28 and 24 of jaws 20 and 21 respectively are positioned beneath head 19. In addition, surface 32 of lever arm 31 rests upon surface 26 of board 27. In the position thus shown, puller 10 is arranged in the manner typical of its operation for extracting nail 18 from boards 27 and 17. Accordingly, with jaw blades 23 and 24 extending beneath head 19 and lever arm 31 resting against surface 26 of board 27, a pivotal motion of handle 11 in the clockwise direction indicated by arrow 50 causes nail puller 10 to pivot about lever arm 31 to the dashed-line depiction in which nail 18 has been withdrawn or extracted from boards 27 and 17.

In accordance with an important aspect of the present invention, the force applied to handle 11 to pivot handle 11 in the direction of arrow 50 communicates a scissor force between puller body 12 and lever arm 31 which, due to pivotal attachment 22, causes closure of jaws 20 and 21 driving jaw blades 23 and 24 against nail 18. As a result, the degree of force applied to handle 11 is communicated to the gripping force applied by jaw blades 23 and 24 to nail 18. In accordance with a further aspect of the present invention, boss 15, limit stop 41 and head 44 cooperate with notch 34 in lever arm 31 to limit the degree of closure of jaws 28 and 24 upon nail !8 and prevent an excessive force applied to nail 11 from severing nail head 19 from nail 18. It should be noted that the separation between puller body 12 and lever arm 31 at which head 44 abutts notch 84 and precludes further inward movement is adjusted by releasing lock nut 43 and threadably moving limit stop 41 either further into limit boss 40 to permit greater closure or outwardly from limit boss 40 to reduce jaw closure. Thus, the present invention nail puller is operative in a first manner prior to the abutment of head 44 within notch 34 to apply a gripping force between jaw blades 23 and 24 upon nail 18 which is directly related to the lateral force applied to handle 11. Once the closure of jaw blades 23 and 24 reaches the predetermined inward limit however, head 44 abuts notch 34 and limit stop 41 and limit boss 40 preclude further inward movement of jaw blades 23 and 24. Thereafter, the gripping force applied to jaw blades 28 and 24 is maintained constant despite increased forces applied laterally to handle 11 to rotate it in the direction of arrow 50. Thus, once head 44 engages notch 34, sufficient force may be applied to handle 11 to pivot nail puller 10 about lever arm 81 without fear of severing nail head 19 from nail 18.

FIG. 2 sets forth a partially section view of nail puller 10. Puller body 12 defines an outwardly extending boss 15 and a rectangular drive receptacle 14. While drive receptacle 14 may be formed in any number of multifaceted interior passages in the embodiment shown in FIG. 2, drive receptacle 14 is formed in a square cross-section passage to receive a conventional ratchet drive. It will be apparent to those skilled in the art however that drive receptacle 14 may for example be hexagonal in cross-section to receive a hexagonal drive tool or shaped in accordance with the cross-section of any number of drive tools without departing from the spirit and scope of the present invention. Puller body 12 defines a static jaw 20 having a jaw blade 23 and a handle socket 13. handle socket 13 in turn defines a threaded aperture 51. A handle 11 defines a handle thread 52 configured to be received by and cooperate with threaded aperture 51 to securely couple handle 11 to puller body 12. In its preferred form, handle 11 is thus detachable from puller body 12 for convenient carrying and for interchange of handles of different lengths and configurations. However, it will be apparent to those skilled in the art that handle 11 and puller body 12 may be formed of a single unit rather than separate detachable elements. A moveable jaw 21 defines a jaw blade 24 positioned in alignment with jaw blade 23 and pivotally attached to puller body 12 by a pivot 22. Moveable jaw 21 further defines an outwardly extending jaw arm 25, a bend 30 and a lever arm 31. Lever arm 31 defines a surface 33, a notch 34 and a bottom surface 32.

In accordance with an aspect of the invention, pivot 22 permits the movement of moveable jaw 21 with respect to puller body 12 and thereby static jaw 20 to produce relative movement between jaw blades 23 and 24. While any number of pivotal attachments between moveable jaw 21 and static jaw 20 may be utilized without departing from the spirit and scope of the present invention, an advantage is achieved in the embodiment shown in FIG. 2 in which moveable jaw 21 and static jaw 20 define apertures (not shown) through which pivot 22 extends. In accordance with conventional fabrication techniques not shown in FIG. 2, pivot 22 supports a conventional fastener on its reverse side to provide an adjustable inward clamping force between moveable jaw 21 and static jaw 20. For example, pivot 22 may comprise a conventional threaded fastener having a threaded portion at its reverse end (not seen) which in turn supports a lock nut (also not shown) whereby the lock nut may be adjusted upon pivot 22 to provide a securing force between moveable jaw 21 and static jaw 20.

Puller body 12 further defines a downwardly and outwardly extending limit boss 40 which in turn defines an internal threaded aperture 50. Limit stop 41 defines a threaded portion 42 at one end and a head 44 at the other Threaded portion 42 is received within threaded aperture 53 in a threaded attachment and a lock nut 43 is received upon thread 42.

In operation, puller 10 functions as set forth in FIG. 1 to extract an embedded nail or similar object by the rotation of handle 11 about the fulcrum provided by surface 32 of lever arm 31. In accordance with an important aspect of the present invention, the position of limit stop 41 within limit boss 40 determines the jaw position between jaw blades 23 and 24 at which head 44 is received within notch 34 of lever arm 31. As described above, the abutment of head 44 within notch 34 precludes further closure of jaws 20 and 21 and limits the minimum spacing between jaw blades 23 and 24. It should be noted that as lever arm 31 pivots about pivot 22 in the directions indicated by arrows 58, the angular separation between jaw blades 23 and 24 shown by arrows 56 and 57 determines a corresponding angle 60. Similarly, the extension of limit stop 41 may be adjusted in the direction shown by arrow 54 by releasing lock nut 43 and threading limit stop 41 farther into or farther out of limit boss 40 by rotation of limit stop 41 in the directions indicated by arrows 55. As a result, the desired minimum closure of jaw blades 23 and 24 may be determined by a corresponding adjustment of limit stop 41. Thus, if limit stop 41 is threaded inwardly to limit boss 40, head 44 is moved away from lever arm 30 and the minimum separation between jaw blades 23 and 24 represented by angle 60 is decreased. Conversely, if limit stop 41 is threaded outwardly from boss 40, the minimum closure angle 60 of jaw blades 23 and 24 is increased.

In accordance with an important aspect of the present invention, lever arm 31 and moveable jaw 21 are freely pivotable about pivot 22 except when head 44 is received within notch 34. Therefore, the present invention puller provides a normal gripping force exerted by jaw blades 23 and 24 upon the embedded object which is directly related to the force between lever arm 31 and handle 11 until head 44 is received within notch 34. It is only upon the occurence of the minimum closure angle between jaw blades 23 and 24 that head 44 of limit stop 41 precludes further relative motion between lever arm 31 and puller body 12 to avoid severing the object gripped between jaw blades 23 and 24.

FIG. 3 sets forth a partial section front view of a portion of puller body 12 and handle 11 showing handle 11 received within handle socket 13. Also shown in FIG. 3 are bosses 15 and 16 extending outwardly on opposite sides of puller body 12 and the extension of drive receptacle 14 entirely and continuously through boss 15, puller body 12 and boss 16. In accordance with an important aspect of the present invention, forces may be imparted to puller body 12 other than by use of handle 11 by removing handle 11 from handle socket 13 and inserting a conventional drive tool configured to be received within and securely grip drive receptacle 14 from either side of puller body 12. In its preferred form, drive receptacle 14 is configured to receive a conventional ratchet drive. However, it will be apparent to those skilled in the art that any number of drive tools may be utilized in a correspondingly configured drive receptacle rather than the square configuration shown for drive receptacle 14.

FIG. 4 sets forth the operation of nail puller 10 utilizing a conventional drive ratchet 70. It should be noted that handle 11 is removed from socket 13. In all other respects, puller 10 remains configured in accordance with the foregoing descriptions in that puller body 12 supports static jaw 20 and jaw blade 23 as well as limit boss 40. Similarly, limit stop 41 is received within limit boss 40 and secured in its extension therefrom by a lock nut 43. Moveable jaw 21 is pivotally secured by a pivot 22 to static jaw 20 and defines an inwardly extending jaw blade 24, a jaw arm 25, a bend 30 and a lever arm 31. Lever arm 31 defines a surface 32 resting upon board surface 26 and a notch 34 receiving head 44 of limit stop 41. Nail head 19 extends upwardly from surface 26 and is received between jaws 20 and 21 such that jaw blades 23 and 24 extend beneath nail head 19 and grip nail 18. Ratchet drive 70 which comprises a conventional ratcheted drive unit of the type used for driving any number of sockets or other tools defines a ratchet head 71 having a square drive 73 and a direction switch 72. In accordance with conventional fabrication techniques, direction switch 72 provides operation of ratchet 70 in either a clockwise or counterclockwise direction. In the use of the present invention puller shown in FIG. 4, it will be recalled by those skilled in the art that there occur frequent situations in the use of such pullers in which the surrounding environment of the to-be-pulled nail precludes or makes difficult the use of a puller due to obstructions in the surrounding structure. For example, in the event nail 18 is embedded within a board having a closely spaced adjacent board such as the joists in a floor or ceiling, the use of a conventional puller having an outwardly extending align handle such as handle 11 is rendered difficult if not impossible due to the obstruction of the adjacent board. In such circumstances, and in accordance with an important aspect of the present invention, handle 11 is removeable and a ratchet drive 70 is substituted as a means of imparting the appropriate force to puller body 12 to withdraw nail 18. As can be seen, ratchet drive 70 may be adjusted to any number of positions rotating in the direction shown by arrow 65 to impart the required pulling force upon the puller body. Therefore, in the position shown in FIG. 4, ratchet drive 70 is pivoted in the direction of arrow 65 causing puller body 12 to pivot about the fulcrum provided by lever arm 31 and withdraw nail 18 from board 27. In all other respects, the operation of puller body 12 and limit stop 41 and lever arm 31 remains the same a that set forth above in FIGS. 1 through 3.

In the embodiments shown in FIGS. 1 through 4, it should be noted that nail head 19 extends above surface 26. Frequently, however, it becomes necessary to extract an embedded nail which has been driven into the body of board 27 such that head 19 is embedded beneath surface 26. In such case, it is necessary to carry forward an additional step prior to placing puller 10 in the pulling position shown in FIGS. 1 through 4 by driving jaw blades 23 and 24 into board 27 to permit jaw blades 23 and 24 to be closed beneath head 19. Various devices, including a slide hammer supported upon the puller hammer, have been utilized to accomplish this function. It will be recognized by those skilled in the art that the present invention puller may similarly accommodate a slide hammer upon handle 11. However, in accordance with an additional aspect of the present invention, the use of a drive ratchet to provide a turning force as shown in FIG. 4 permits the removal of handle 11 and makes possible the above-described operation by striking surface 36 of socket 13 with a hammer or similar object to drive jaw blades 23 and 24 beneath nail head 19.

FIG. 5 sets forth an alternate embodiment of the present invention puller in which a puller body 80, similar to puller body 12, defines a handle socket 90 identical to socket 13 of puller body 12, a limit boss 81 and a static jaw 95. Puller body 80 further defines a boss 92 and a drive receptacle 93. A limit stop 83, identical to limit stop 41, is received within limit boss 80 and supports a lock nut 82. Limit stop 83 further defines a head 84. Static jaw 95 defines a jaw blade 97 and a moveable jaw 94 is pivotally attached to static jaw 95 by a pivot 89 and defines a jaw blade 96. Moveable jaw 94 further defines a jaw arm 88 and a lever arm 87. Lever arm 87 further defines a notch 86 which receives head 84 of limit stop 88. As will be apparent from comparison of FIGS. 4 and 5, puller body 80, limit stop 83 and moveable jaw 94 are identical to puller body 12, limit stop 41 and moveable jaw 21 of the embodiment shown in FIG. 4. Puller body 80 differs from puller body 12 in that it further defines an additional handle socket 91 aligned in a perpendicular relationship to handle socket 90. Handle socket 91 is otherwise identical to handle socket 90 and receives handle 11 in the manner shown above in FIG. 2 for handle socket 13. Both handle sockets 90 and 91 are identical to handle socket 13 and defines corresponding threaded apertures identical to threaded aperture 51. The advantage of the embodiment shown in FIG. 5 provided by the pair of handle sockets 90 and 91 will be apparent by comparison of FIGS. 2 and 5 in that the presence of handle socket 90 does not interfere with the use of handle 11 within handle socket 90 in the manner shown in FIG. 2. However, additionally, the presence of handle socket 91 permits an alternative arrangement for handle 11 and puller body 80 in which handle 11 may be inserted within handle socket 91 as shown in FIG. 5 and the required pulling force may be applied to handle 11 in the direction shown by arrow 85. Thus, many of the above-described inconvenient or difficult situations for use of the present invention puller may be met without the need for using an additional drive ratchet 70 (seen in FIG. 4). In addition, the use of handle 11 as shown in FIG. 5 within handle socket 91 permits the application of a hammer blow to surface 98 of handle socket 90 to drive jaw blades 96 and 97 beneath the head of the embedded nail in the manner described in connection with FIG. 4.

What has been shown is a flexible easy to use, improved nail puller which may readily be utilized in a variety of difficult environments and which provides a novel limit to the closure of the gripping jaws to prevent the severing of the embedded object during the pulling process.

While particular embodiments of the present invention have been shown and described it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in removing an elongated object partially embedded in a body having a surface such that an extending portion of said elongated object extends beyond said surface, a puller comprising:

a puller body having a first jaw;

a second jaw having a lever arm defining a notch surface;

pivot means joining said first and second jaws in a pivotal attachment in which said second jaw is movable with respect to said first jaw and said first and second jaws may grasp said extending portion of said elongated object;

handle means coupled to said puller body such that force applied to said handle means in a first direction causes closure of said first and second jaws; and limit means interposed between said puller body and said lever arm for limiting closure of said first and second jaws at a predetermined jaw separation, said limit means including a threaded limit aperture within said puller body and an elongated limit stop having a first end and a threaded second end, said second end being threadably received within said threaded limit aperture and said first end abutting said lever arm at said notch surface, said puller being operative by placing said lever arm against said surface and positioning said first and second jaws on opposed sides of said extending portion of said elongated object.

2. A puller as set forth in claim 1 wherein said pivot means include adjustable friction means causing said second jaw to tend to remain as positioned despite the orientation of said puller during use.

3. A puller as set forth in claim 1 wherein said handle means include a first socket having a first internal passage and an elongated handle having a first end configured to be received within said first internal passage of said first socket.

4. A puller as set forth in claim 3 wherein said first internal passage of said first socket supports a first internal thread and wherein said first end of said elongated handle includes an external thread cooperating with said first internal thread of said first socket to secure said handle therein.

5. A puller as set forth in claim 4 wherein said puller body defines a multifaceted aperture configured to receive a multifaceted tool.

6. A puller as set forth in claim 5 wherein said multifaceted aperture is a square cross section aperture configured to receive a square ratchet drive.

7. A puller as set forth in claim 4 further including a second socket having a second internal passage having a second internal thread for receiving said first end of said elongated handle, said second socket being angularly displaced from said first socket.

8. A puller as set forth in claim 7 wherein said puller body defines a multifaceted aperture configured to receive a multifaceted tool.

9. A puller as set forth in claim 8 wherein said multifaceted aperture is a square cross section aperture configured to receive a square ratchet drive.

10. A puller as set forth in claim 1 wherein said puller body further includes an extending boss surrounding said threaded limit aperture and defining a lock surface and wherein said limit stop further includes a lock nut threadably received on said threaded second end abutting said lock surface to fix the position of said limit stop.

* * * * *